US008389881B2

(12) United States Patent
Gregory et al.

(10) Patent No.: US 8,389,881 B2
(45) Date of Patent: Mar. 5, 2013

(54) CABLE TERMINATION SYSTEMS AND ISOLATING APPARATUS FOR ELECTRICAL POWER TRANSMISSION CONDUCTORS AND METHODS USING THE SAME

(75) Inventors: Owen Gregory, Apex, NC (US); Edward O'Sullivan, Cary, NC (US); Sherif Kamel, Cary, NC (US); Steven Mitchell, Thompsons Station, TN (US)

(73) Assignee: Tyco Electronics Corporation, Berwyn, PA (US)

( * ) Notice: Subject to any disclaimer, the term of this patent is extended or adjusted under 35 U.S.C. 154(b) by 0 days.

(21) Appl. No.: 13/470,230

(22) Filed: May 11, 2012

(65) Prior Publication Data

US 2012/0220151 A1 Aug. 30, 2012

Related U.S. Application Data

(63) Continuation of application No. 12/482,921, filed on Jun. 11, 2009, now Pat. No. 8,198,558.

(51) Int. Cl.
*H01R 25/14* (2006.01)

(52) U.S. Cl. ..... 200/51 R; 200/48 R; 439/449; 439/783

(58) Field of Classification Search ..... 200/51 R, 200/48 KB, 48 R, 49; 218/12; 439/449, 439/452, 459, 460, 470, 472, 783, 790
See application file for complete search history.

(56) References Cited

U.S. PATENT DOCUMENTS 3,958,089 A 5/1976 Anderson ..... 200/48 KB
4,183,686 A 1/1980 De France
5,581,051 A 12/1996 Hill
5,942,723 A * 8/1999 Laricchia ..... 200/49
6,851,262 B1 2/2005 Gregory et al.
7,498,528 B2 3/2009 De France ..... 200/17 R

FOREIGN PATENT DOCUMENTS

CA 2 092 741 5/2004
WO WO 2008/013891 A2 1/2008

OTHER PUBLICATIONS

U.S. Appl. No. 12/342,113, filed Dec. 23, 2008, titled "Isolating Apparatus for Electric Power Lines and Methods for Forming and Using the Same," 31 pages.
*Distribution Connectors Deadends Automatic Copper*, Mar. 2009, HUBBELL® Power Systems, 35 pages.
*FCI-BurndyA® Products Introduces New Wejtapâ,, ¢ In-Line Disconnect Switch for Distribution Applications*, © 2007-2008 FCI, 1 page.
*Customer Manual, AMPACT* In-Line Disconnect Assemblies 83881-□, 109202-□, 109203-□, 109256-□, 109257-□, and 109258-□*, © 2002 Tyco Electronics Corporation, 4 pages.
*AMPACT In-Line Disconnect*, admitted prior art, 2 pages.

(Continued)

*Primary Examiner* — Felix O Figueroa
(74) *Attorney, Agent, or Firm* — Myers Bigel Sibley & Sajovec, PA

(57) ABSTRACT

A conductor termination system for use with an electrical power transmission conductor includes a termination assembly and a connector. The termination assembly includes an end member and an integral retainer mechanism. The end member includes a receiver portion configured to receive a segment of the conductor. The retainer mechanism includes a moveable keeper member on the end member. The retainer mechanism is operable to selectively clamp a segment of the conductor in the receiver portion to the end member and to apply a retention load to the conductor segment. The connector is adapted to be applied to the end member and the conductor to securely clamp the conductor segment to the end member.

22 Claims, 11 Drawing Sheets

OTHER PUBLICATIONS

Notification of Transmittal of the International Search Report and the Written Opinion of the International Searching Authority, or the Declaration in corresponding PCT Application No. PCT/US2010/036987 mailed Jun. 17, 2011 (9 pages).

Notification Concerning Transmittal of International Preliminary Report on Patentability (Chapter I of the Patent Cooperation Treaty) in corresponding PCT Application No. PCT/US2010/036987 mailed Dec. 22, 2011 (6 pages).

* cited by examiner

CABLE TERMINATION SYSTEMS AND ISOLATING APPARATUS FOR ELECTRICAL POWER TRANSMISSION CONDUCTORS AND METHODS USING THE SAME

RELATED APPLICATION(S)

The present application is a continuation of and claims priority from U.S. patent application Ser. No. 12/482,921, filed Jun. 11, 2009 now U.S. Pat. No. 8,198,558, the disclosure of which is incorporated herein by reference in its entirety.

FIELD OF THE INVENTION

The present invention relates to electrical power lines and, more particularly, to cable termination systems for electrical power lines.

BACKGROUND OF THE INVENTION

Electrical cables often must be terminated or joined in various environments, such as underground or overhead. Such cables may be, for example, high voltage electrical distribution or transmission lines. In order to form such connections, a connector may be employed.

In-line isolation devices such as in-line disconnect switches are commonly employed in electrical power transmission lines where it is desired to permanently or selectively isolate a power line such as an overhead power line. Known isolation devices include a pair of end pieces (which may be referred to as dead ends) connected by an elongate insulator. The end pieces are each clamped to a power line using wedge connectors. The power line is then cut between the end pieces so that the isolation device mechanically couples and electrically isolates the two ends of the power line. Examples of devices of this type are disclosed in Canadian Patent No. 2,092,741, U.S. Pat. No. 5,581,051 to Hill, and U.S. Pat. No. 5,942,723 to Laricchia.

SUMMARY OF THE INVENTION

According to embodiments of the present invention, a conductor termination system for use with an electrical power transmission conductor includes a termination assembly and a connector. The termination assembly includes an end member and an integral retainer mechanism. The end member includes a receiver portion configured to receive a segment of the conductor. The retainer mechanism includes a moveable keeper member on the end member. The retainer mechanism is operable to selectively clamp a segment of the conductor in the receiver portion to the end member and to apply a retention load to the conductor segment. The connector is adapted to be applied to the end member and the conductor to securely clamp the conductor segment to the end member.

In some embodiments, the receiver portion has a longitudinal axis and is configured to laterally receive the conductor segment to extend along the longitudinal axis and the retainer mechanism is selectively alternatively positionable in each of: an open position, wherein the keeper member is positioned such that the receiver portion is open to laterally receive the conductor segment; and a clamping position wherein the keeper member is positioned to prevent removal of the conductor segment laterally from the receiver portion and to apply a clamping load to the conductor segment to resist axial displacement of the conductor segment with respect to the receiver portion.

The retainer mechanism may be further selectively alternatively positionable in a closed position, wherein the keeper member is positioned to retain the conductor segment and to prevent removal of the conductor segment laterally from the receiver portion while permitting axial displacement of the conductor segment with respect to the receiver portion.

In some embodiments, the keeper member is pivotable about a pivot axis and across the receiver portion between the open and clamping positions. According to some embodiments, the retainer mechanism includes a latch member on a side of the receiver portion opposite the pivot axis, and the keeper member is anchored by the latch member when in the clamping position.

In some embodiments, the latch member includes a latch bolt, the retainer mechanism further includes a pivot bolt about which the keeper member pivots about the pivot axis between the open and clamping positions, and the keeper member can be clamped onto the conductor segment by tightening the latch bolt and the pivot bolt.

The keeper member may include an engagement portion configured to substantially conform to and transfer the clamping load to the conductor segment.

According to some embodiments, the connector comprises a wedge connector adapted to be force-applied to the end member and the conductor, the wedge connector including a sleeve member defining a sleeve cavity, and a wedge member configured to be forcibly inserted into the sleeve cavity to capture the conductor segment and the end member therebetween such that the wedge connector inhibits axial movement of the wedge connector, the conductor segment and the end member.

In some embodiments, the conductor termination system is an isolating apparatus further including an elongate insulator having opposed first and second insulator ends, a second termination assembly, and a second connector. The second termination assembly includes a second end member and a second integral retainer mechanism. The second end member includes a second receiver portion configured to receive a second segment of the conductor. The second integral retainer mechanism includes a second moveable keeper member on the second end member. The second keeper member is operable to selectively clamp the second conductor segment in the receiver portion to the end member and to apply a retention load to the conductor. The second connector is adapted to be applied to the second end member and the second conductor segment to securely clamp the second conductor segment to the second end member. The first insulator end is secured to the first end member and the second insulator end is secured to the second end member.

In some embodiments, the conductor termination system further includes a switch mechanism to selectively alternatively electrically connect and disconnect the first and second end members and thereby the first and second conductor segments.

According to some embodiments, the conductor termination system includes an electrical transmission conductor. A segment of the conductor is disposed in the receiver portion of the end member. The conductor segment is clamped in the receiver portion by the keeper member such that relative axial displacement between the end member and the conductor segment is thereby resisted. The conductor segment is securely clamped to the end member by the connector.

According to method embodiments of the present invention, a method for forming a conductor termination assembly with an electrical power transmission conductor includes providing a termination assembly including: an end member including a receiver portion configured to receive a segment of the conductor; and an integral retainer mechanism including a moveable keeper member on the end member. The method further includes: placing a segment of the conductor in the receiver portion; applying a connector to the end member and the conductor segment to securely clamp the conductor segment to the end member; and using the retainer mechanism, clamping the conductor segment in the receiver portion and applying a retention load to the conductor segment with the keeper member.

In some embodiments, the receiver portion has a longitudinal axis and is configured to laterally receive the conductor segment to extend along the longitudinal axis, and the method includes: positioning the retainer mechanism in an open position, wherein the keeper member is positioned such that the receiver portion is open to laterally receive the conductor segment; thereafter placing the conductor segment in the receiver portion with the retainer mechanism in the open position; and thereafter positioning the retainer mechanism in a clamping position wherein the keeper member prevents removal of the conductor segment laterally from the receiver portion and applies a clamping load to the conductor segment to resist axial displacement of the conductor segment with respect to the receiver portion.

The method may include, after placing the conductor segment in the receiver portion and prior to positioning the retainer mechanism in the clamping position, positioning the retainer mechanism in a closed position, wherein the keeper member is positioned to retain the conductor segment and to prevent removal of the conductor segment laterally from the receiver portion while permitting axial displacement of the conductor segment with respect to the receiver portion.

In some embodiments, the connector comprises a wedge connector including a sleeve member defining a sleeve cavity and a wedge member. The step of applying the connector to the end member and the conductor segment is executed while the retainer mechanism is in the closed position. Applying the wedge connector to the end member and the conductor segment includes forcibly inserting the wedge connector into the sleeve cavity using a powder actuated tool to capture the conductor segment and the end member therebetween such that the wedge connector inhibits axial movement of the wedge connector, the conductor segment and the end member.

According to some embodiments, the method includes pivoting the keeper member about a pivot axis and across the receiver portion between the open and clamping positions. In some embodiments, the retainer mechanism includes a latch member on a side of the receiver portion opposite the pivot axis, and the keeper member is anchored by the latch member when in the clamping position. In some embodiments, the latch member includes a latch bolt, the retainer mechanism further includes a pivot bolt about which the keeper member pivots between the open and clamping positions, and the method includes clamping the keeper member onto the conductor segment by tightening the latch bolt and the pivot bolt.

According to embodiments of the present invention, an isolating apparatus for an electrical power transmission conductor includes an elongate insulator, a first termination assembly, and a second termination assembly. The insulator has opposed first and second insulator ends. The first termination assembly includes a first end member and the second termination assembly includes a second end member. The first insulator end is secured to the first end member and the second insulator end is secured to the second end member. The first termination assembly further includes: a receiver portion of the first end member configured to receive a segment of the conductor; and an integral retainer mechanism including a moveable keeper member on the first end member. The retainer mechanism is operable to selectively position the keeper member to prevent removal of a segment of the conductor laterally from the receiver portion and to apply a clamping load to the conductor segment to resist axial displacement of the conductor segment with respect to the receiver portion.

In some embodiments, the isolating apparatus further includes a switch mechanism to selectively alternatively electrically connect and disconnect the first and second end members.

Further features, advantages and details of the present invention will be appreciated by those of ordinary skill in the art from a reading of the figures and the detailed description of the preferred embodiments that follow, such description being merely illustrative of the present invention.

DETAILED DESCRIPTION OF EMBODIMENTS OF THE INVENTION

Figure 1:
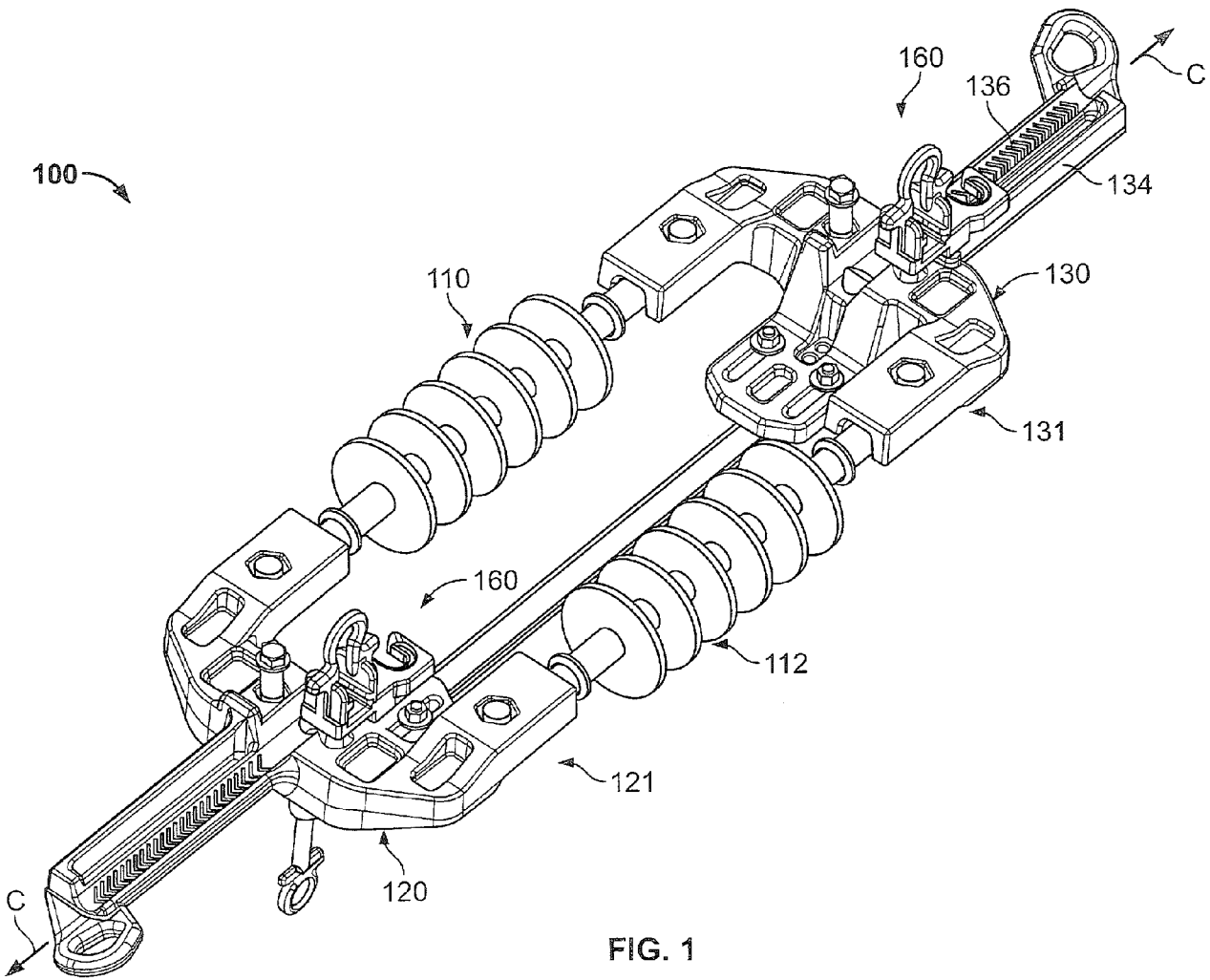
FIG. 1 is a top perspective view of an isolating apparatus according to embodiments of the present invention.

The present invention now will be described more fully hereinafter with reference to the accompanying drawings, in which illustrative embodiments of the invention are shown. In the drawings, the relative sizes of regions or features may be exaggerated for clarity. This invention may, however, be embodied in many different forms and should not be construed as limited to the embodiments set forth herein; rather, these embodiments are provided so that this disclosure will be thorough and complete, and will fully convey the scope of the invention to those skilled in the art.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90° or at other orientations) and the spatially relative descriptors used herein interpreted accordingly.

As used herein, the singular forms "a", "an" and "the" are intended to include the plural forms as well, unless expressly stated otherwise. It will be further understood that the terms "includes," "comprises," "including" and/or "comprising," when used in this specification, specify the presence of stated features, integers, steps, operations, elements, and/or components, but do not preclude the presence or addition of one or more other features, integers, steps, operations, elements, components, and/or groups thereof It will be understood that when an element is referred to as being "connected" or "coupled" to another element, it can be directly connected or coupled to the other element or intervening elements may be present. As used herein, the term "and/or" includes any and all combinations of one or more of the associated listed items.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of this specification and the relevant art and will not be interpreted in an idealized or overly formal sense unless expressly so defined herein.

Figure 7:
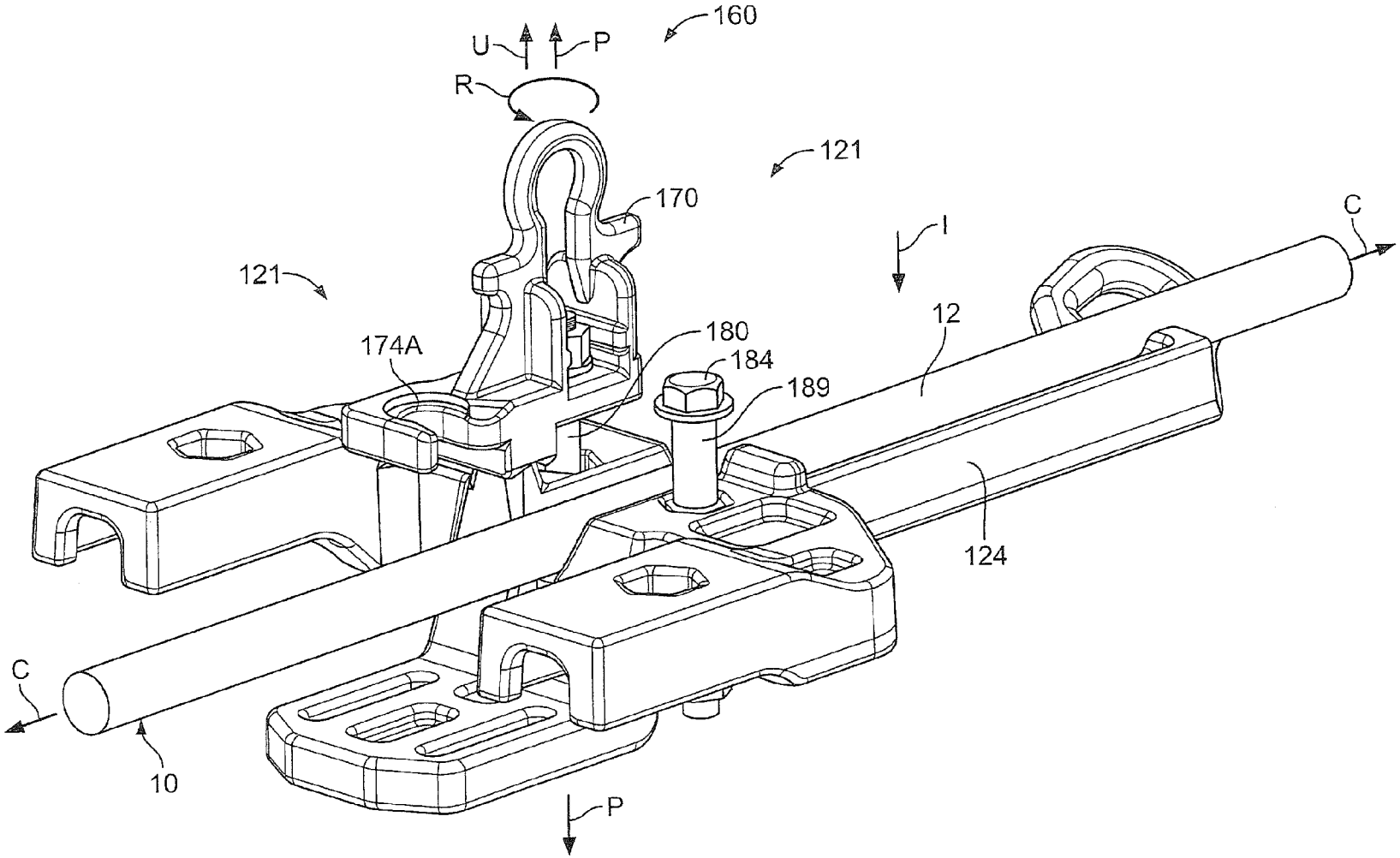
FIG. 7 is an enlarged, top front perspective view of the termination assembly of FIG. 3 with a cable segment mounted therein, and wherein a retainer mechanism thereof is in an open position.
Figure 8:
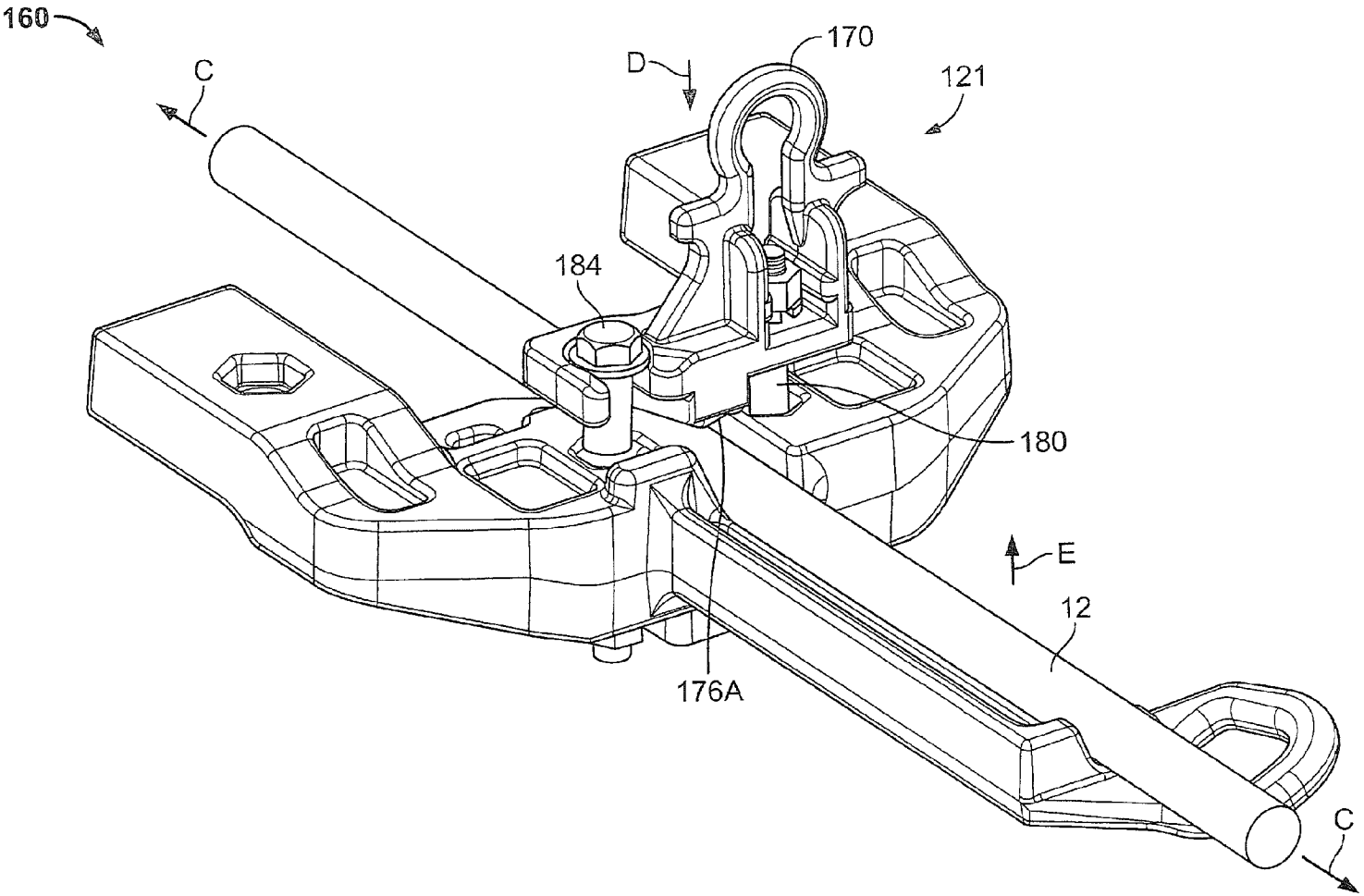
FIG. 8 is an enlarged, top rear perspective view of the termination assembly of FIG. 3 with the cable segment mounted therein, and wherein the retainer mechanism is in a closed position.
Figure 9:
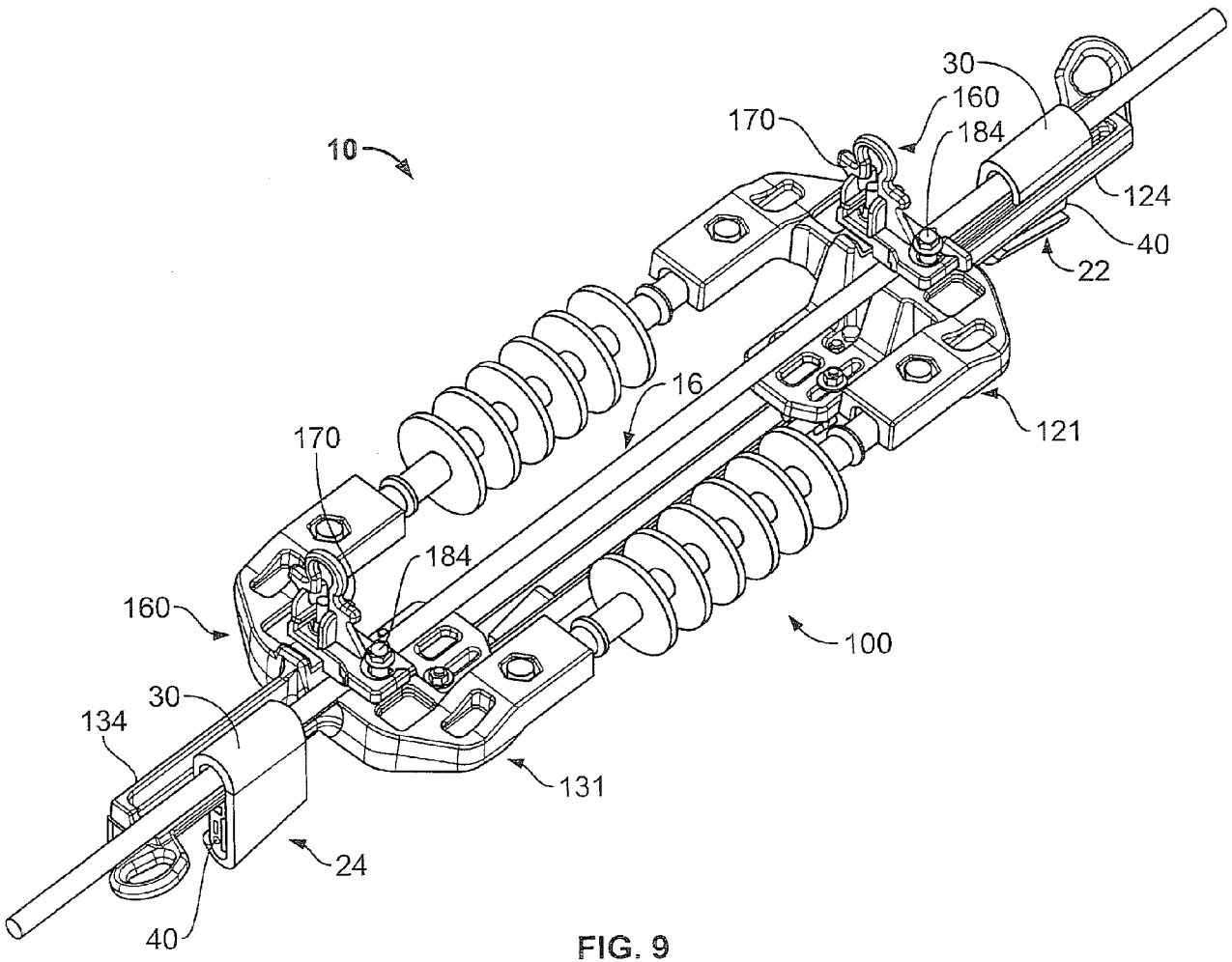
FIG. 9 is a top perspective view of the isolating apparatus of FIG. 1 mounted on the power line, wherein a pair of wedge connectors are mounted on the termination assemblies of the isolating apparatus and the retainer mechanisms thereof are each in the closed position.
Figure 10:
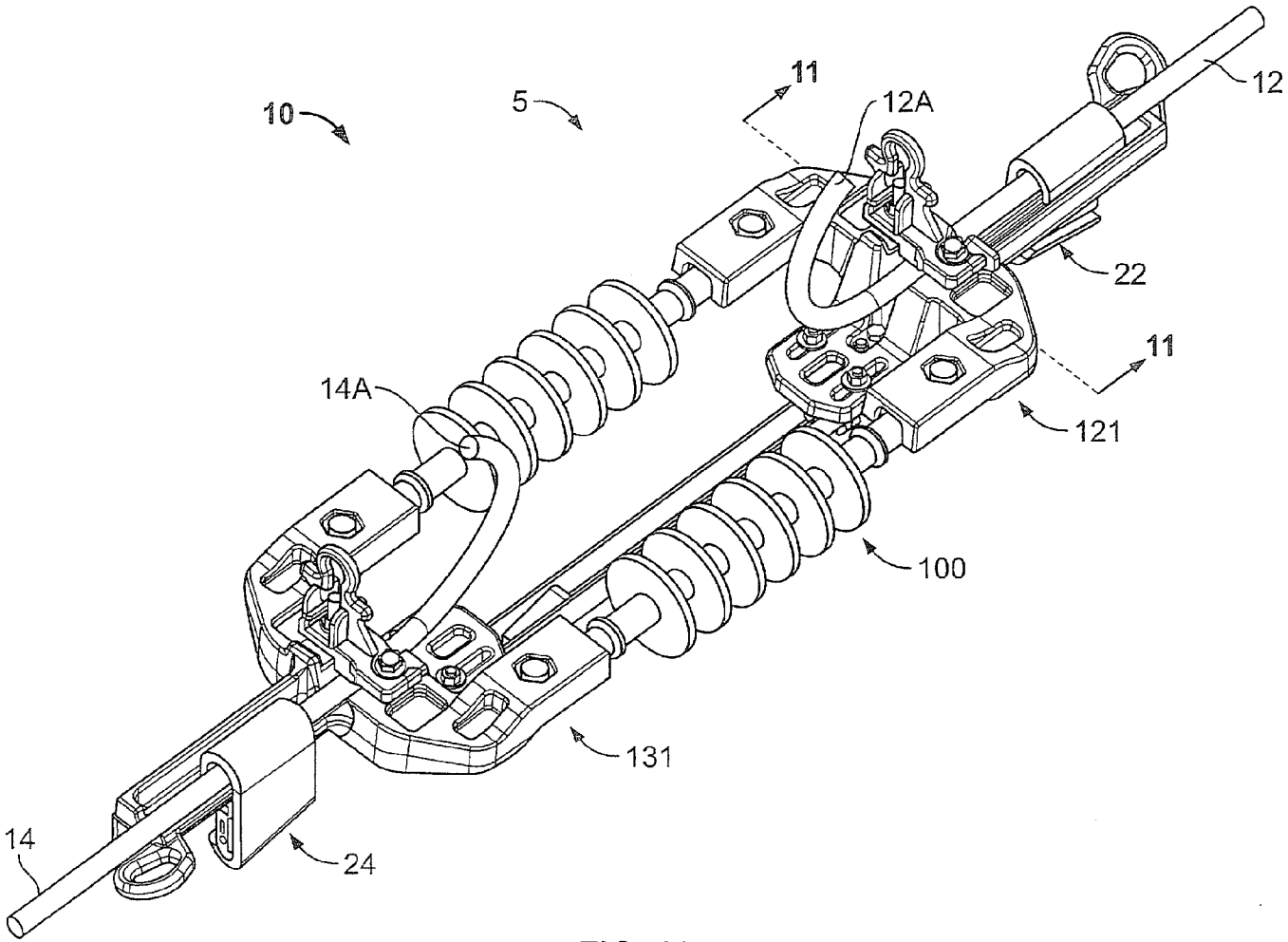
FIG. 10 is a top perspective view of the isolating apparatus of FIG. 1 mounted on the power line, wherein the pair of wedge connectors are mounted on the termination assemblies of the isolating apparatus and the retainer mechanisms thereof are each in a clamping position to form an in-line isolation assembly.
Figure 11:
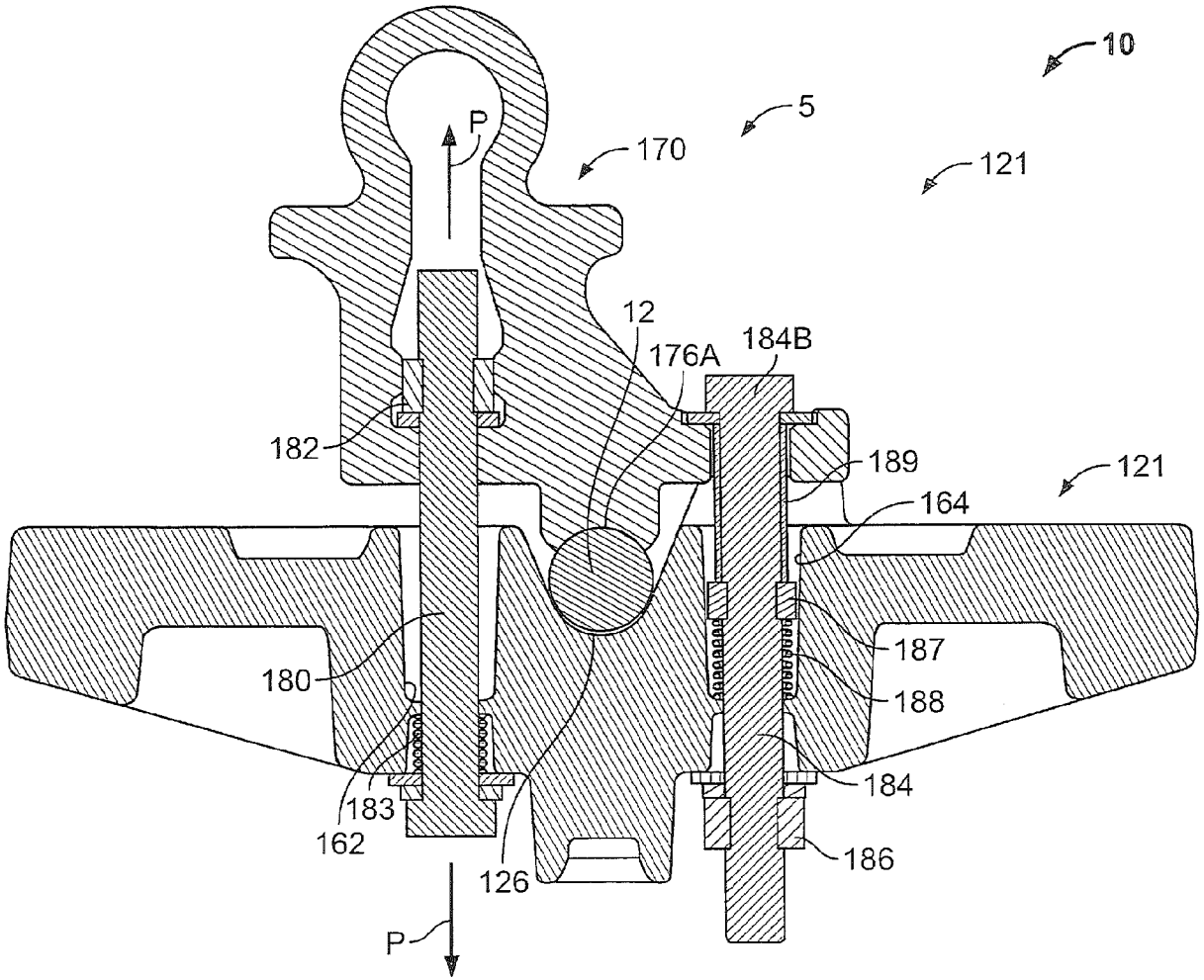
FIG. 11 is a cross-sectional view of the in-line isolation assembly of FIG. 10 taken along the line 11-11 of FIG. 10.

With reference to FIGS. 1-11, a connector unit or in-line isolating apparatus 100 according to embodiments of the present invention is shown therein. The isolating apparatus 100 may be used with a pair of wedge connectors 22, 24 (FIG. 10) (or other suitable connectors) to form an in-line isolation assembly 5 (FIGS. 10 and 11) wherein a pair of power lines, conductor segments or conductors 12, 14 are mechanically coupled and electrically isolated by the isolating apparatus 100 and the wedge connectors 22, 24. The isolating apparatus 100 and the wedge connectors 22, 24 together form a cable termination system 10 (FIGS. 9-11). The isolating apparatus 100 may be referred to as an in-line disconnect device or an in-line switch when it further incorporates a switch mechanism as discussed herein. According to other embodiments, aspects of the present invention may be employed in a connector unit of a type other than an in-line isolating apparatus, such as a dead end connector adapted to be directly secured to a wall or post or to a bracket that is itself secured to a wall or post.

The conductors 12, 14 may be formed of any suitable electrically conductive material. The conductors 12, 14 may each include a plurality of separable elongate strands (e.g., helically wound). Alternatively, one or both of the conductors 12, 14 may be solid. The conductors 12, 14 may be initially provided as an integral (mechanically and electrically continuous) power line 16 (FIG. 9) that is severed into the conductors 12, 14 as part of the procedure for forming the in-line isolation assembly 5 (FIG. 10).

The isolating apparatus 100 (FIGS. 1 and 2) includes a pair of termination assemblies 121, 131 joined by a pair of insulators 110, 112. The isolating apparatus 100 may further include a blade switch mechanism 140 and a plurality of connecting bolts 102 and nuts 104. The bolts 102 and nuts 104 may be replaced with other types of fastening components such as rivets. The isolating apparatus 100 has a lengthwise axis L-L (FIG. 2).

Figure 2:
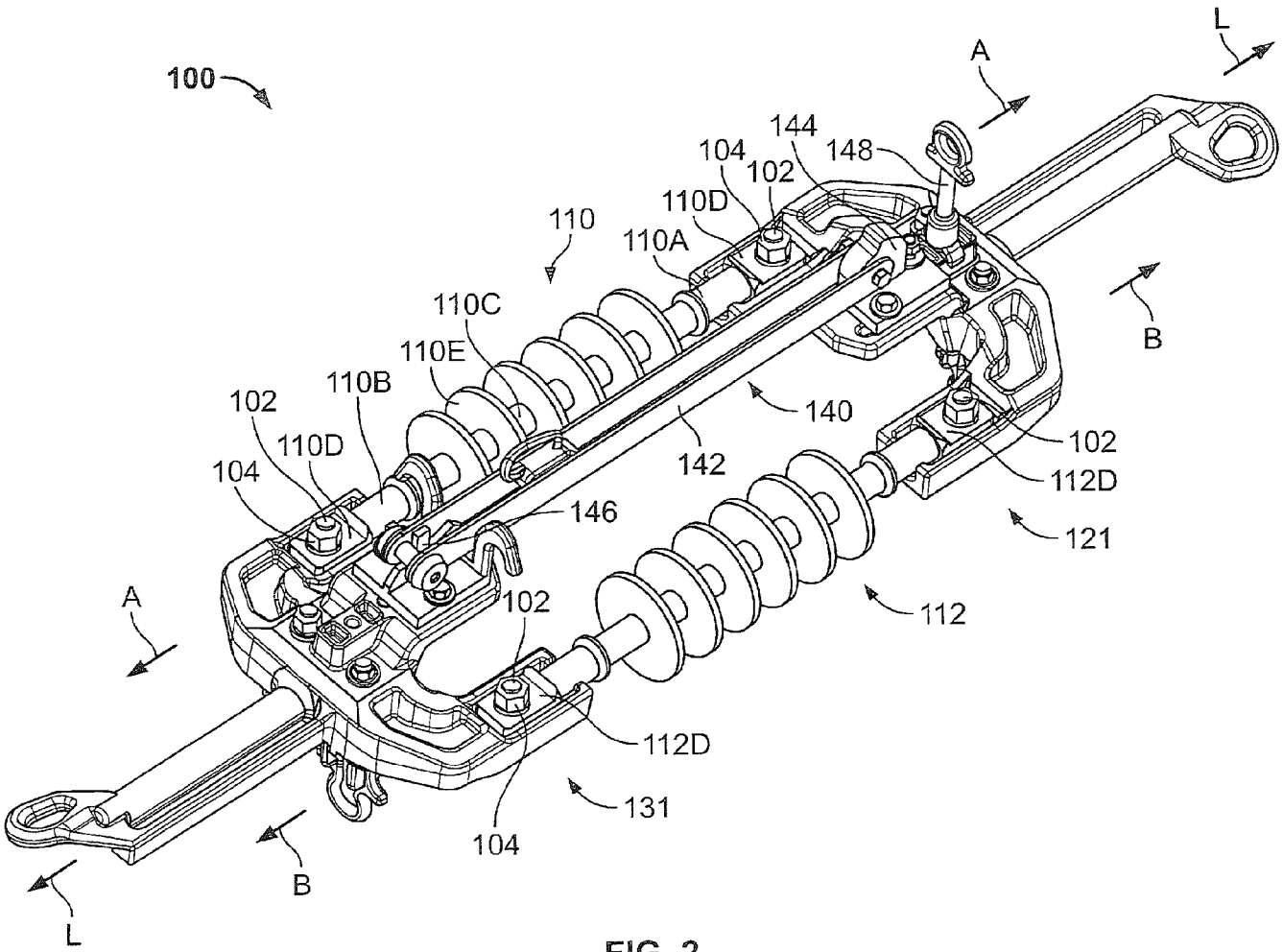
FIG. 2 is a bottom perspective view of the isolating apparatus of FIG. 1.
Figure 3:
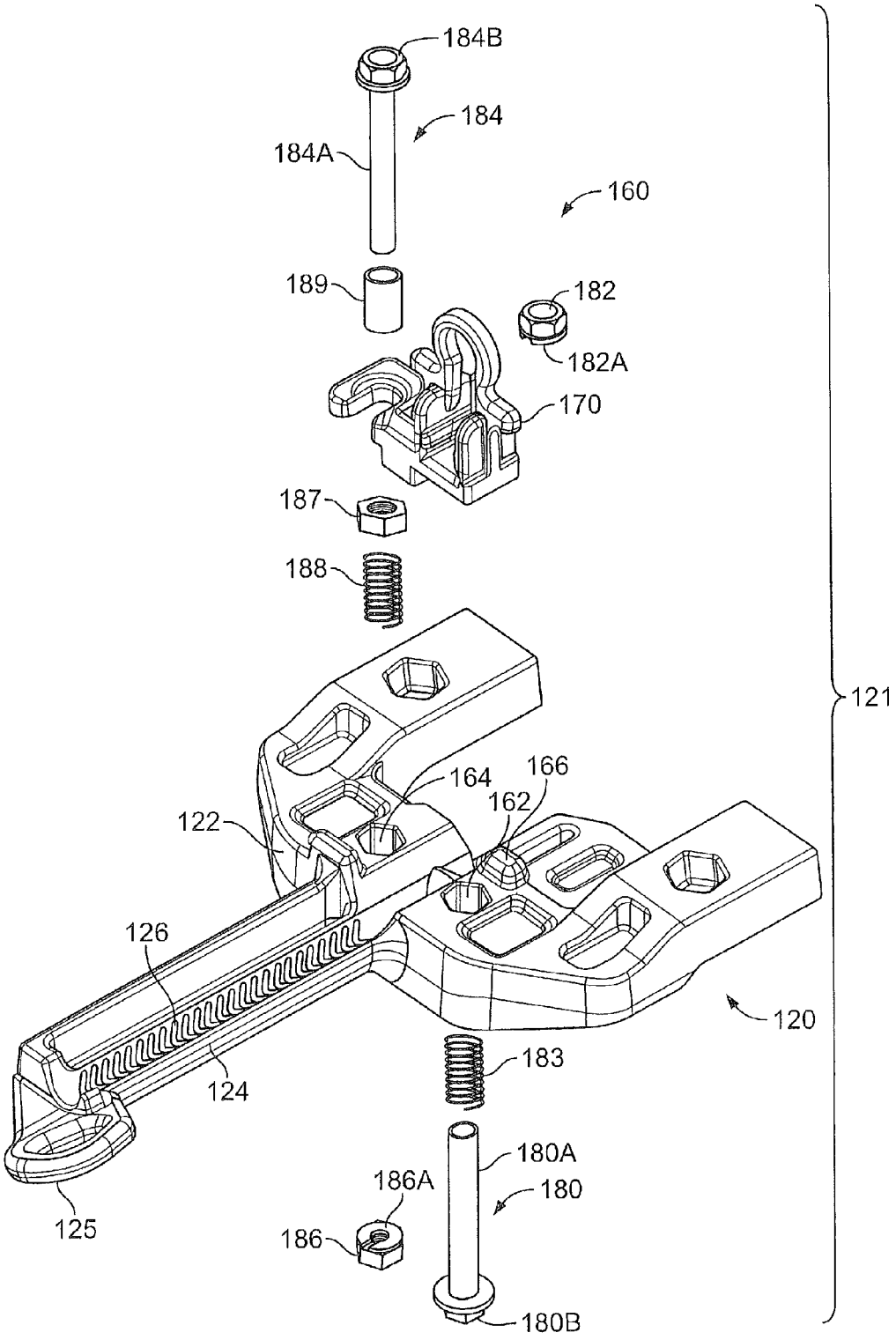
FIG. 3 is an exploded, top perspective view of a termination assembly forming a part of the isolating apparatus of FIG. 1.
Figure 4:
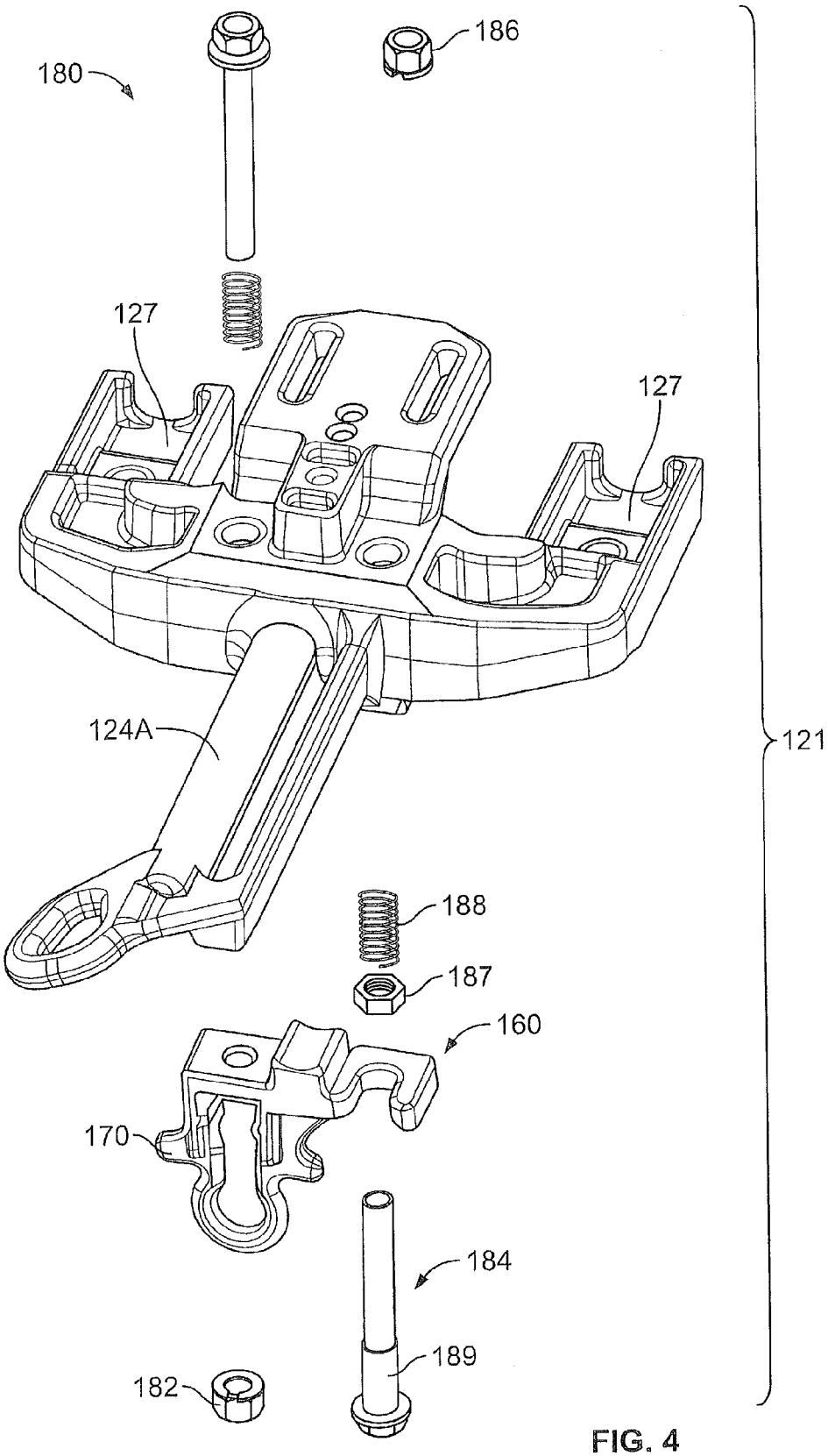
FIG. 4 is an exploded, bottom perspective view of the termination assembly of FIG. 3.

The insulator 110 (FIG. 2) is elongate and has opposed ends 110A, 110B and a lengthwise insulator axis A-A (FIG. 2). The insulator 110 includes an electrically insulating body 110C and connector lugs 110D secured to either end of the body 110C (e.g., by crimping). The insulating body 110C may be of any suitable construction. According to some embodiments, the insulating body 110C includes a rigid (e.g., fiberglass) rod surrounded by a rubberized cover. Radially outwardly extending sheds 110E may be provided, which may form a part of the rubberized cover. According to some embodiments, the insulating body 110C is formed of any suitable material, such as aluminum. A fastening hole extends laterally through each lug 110D.

The insulator 112 may be formed in the same manner as described above for the insulator 110 and has a lengthwise axis B-B (FIG. 2).

The end assembly 121 (FIGS. 3 and 4) includes an end member 120 and a retainer mechanism 160 (FIG. 1). The end member 120 includes a body or yoke member 122 and a coupling shank or rod 124, which may be integrally formed with the yoke member 122. A concave, lengthwise extending receiver portion or conductor groove 126 is defined in the coupling rod 124, and a pulling eye 125 is provided on an outer end of the rod 124. The conductor groove 126 defines a longitudinal conductor axis C-C (FIGS. 1, 7 and 8).

The end member 120 may be formed of any suitable material. According to some embodiments, the end member 120 is formed of an electrically conductive metal. According to some embodiments, the end member 120 is formed of aluminum. According to some embodiments, the end member 120 is unitarily cast.

Laterally spaced apart mounting structures 127 are located on the inner end of the yoke member 120, and may be integrally formed (e.g., by casting) therewith. A mounting pocket or slot may be defined in each mounting structure 127 to receive the mounting lugs of the insulators 110, 112.

According to some embodiments and as illustrated, the retainer mechanism 160 (FIGS. 3-5 and 11) includes a keeper member or bar 170, a pivot bolt 180, a pivot nut 182, a lock washer 182A, a pivot spring 183, a latch bolt 184, a latch nut 186, a lock washer 186A, a set nut 187, a spacer sleeve 189, a lockout post 166, a pivot bolt hole 162 (defined in the end member 120) and a latch bolt hole 164 (also defined in the end member 120).

The pivot bolt 180 has a threaded shank 180A extending through the pivot bolt hole 162. The spring 183 is mounted on the shank 180A and captured in the hole 162 by a head 180B of the pivot bolt 180.

Figure 5:
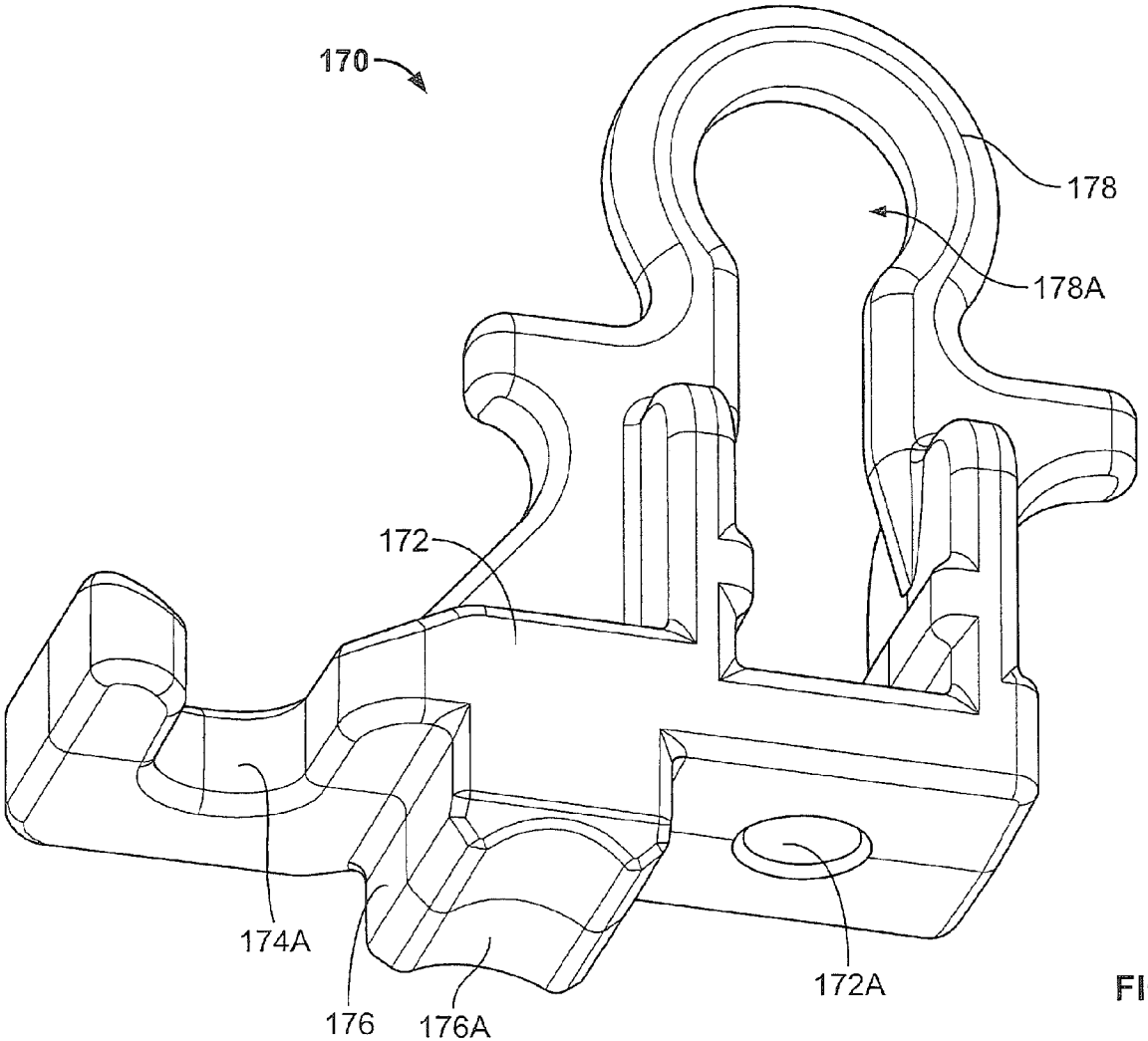
FIG. 5 is an enlarged, perspective view of a keeper member of the termination assembly of FIG. 3.

The keeper bar 170 includes a body 172, a pressure head 176, and a handle 178 (see FIG. 5). The keeper bar 170 is pivotably coupled to the end member 120 by the pivot bolt 180, which extends through a pivot hole 172A in the body 172. The keeper bar 170 is secured to the end member 120 by the pivot bolt 180 and the pivot nut 182. The spring 183 tends to pull the keeper bar 170 toward the end member 120 via the pivot bolt 180. The pressure head 176 includes a concave seat surface 176A. The keeper member 170 further includes a laterally open latch slot 174A opposite the pivot hole 172A. The latch slot 174A may be chamfered. The handle 178 defines an eyelet 186A for manipulating the keeper bar 170 using a hot stick or other tool, for example.

The latch bolt 184 includes a threaded shank 184A that extends through the latch bolt hole 164 and is secured to the end member 120 by the nut 186. The spring 188 is mounted on the shank 186A and captured in the latch bolt hole 164 by the set nut 187. The latch spring 188 tends to bias the head 184B of the latch bolt 184 outwardly from the end member 120. The spacer sleeve 189 is mounted on the shank 184A and captured between the set nut 187 and the latch bolt head 184B.

As discussed below, the keeper bar 170 is rotatable in a direction R (FIG. 7) about the pivot bolt 180 and a pivot axis P-P between an open position (as shown in FIGS. 1, 2 and 7) and a closed position (as shown in FIGS. 8 and 9). In the open position, the keeper bar 170 permits a conductor 12 to be laid laterally into the groove 126 (e.g., in a direction I (FIG. 7) substantially perpendicular to the groove axis C-C). In the closed position, the keeper bar 170 spans the groove 126 and can thereby prevent or inhibit lateral removal of the conductor 12 from the groove 126. In the closed position, the shank 184A of the latch bolt 184 is received in the latch slot 174A. Transition from the open position to the closed position can be facilitated by the latch spring 188, which tends to pop the latch bolt 184 up to provide clearance for the latch slot 174A.

The termination assembly 131 may be constructed in the same manner as the termination assembly 121, and has a retainer mechanism 160, a coupling rod 134 and a cable groove 136 (FIG. 1). According to some embodiments and as shown, the retainer mechanisms 160 of the termination assemblies 121, 131 are configured such that the keeper bars 170 thereof open to the same side (as shown in FIG. 1).

The insulators 110, 112 connect and extend between the end members 120, 130 in spaced apart, coextensive, substantially parallel relation. More particularly, the lugs 110D, 112D of the insulators 110, 112 are secured to respective ones of the mounting structures 127, 137 by the bolts 102 and nuts 104. It will be appreciated that other methods may be used to secure the insulators 110, 112 to the end members 120, 130. The insulators 110, 112 may be coupled to the end members 120, 130 as disclosed in U.S. patent application Ser. No. 12/342,113, filed Dec. 23, 2008, the disclosure of which is incorporated herein by reference.

The blade switch mechanism 140 (FIG. 2) may include an electrically conductive blade member 142, a pivot bracket 144 and a latch mechanism 146. The latch mechanism 146 is mounted on the end member 120 and the pivot bracket 144 is mounted on the end member 130. The blade member 142 is pivotably coupled to the pivot bracket 144 for rotation about a transverse pivot axis between an open position, wherein the blade member 142 is swung away from the latch mechanism 146 and the end member 130, and a closed position as shown in FIG. 2. In the closed position, the blade member 142 provides electrical continuity between the end members 120 and 130 (more particularly, from the coupling rod 124 to the coupling rod 134). When the blade member 142 is in the open position, the end members 120, 130 are coupled only by the insulators 110, 112, and are electrically isolated from one another.

The isolating apparatus 100 may further include a lockout mechanism 148 as disclosed in U.S. patent application Ser. No. 12/342,113, filed Dec. 23, 2008, the disclosure of which is hereby incorporated by reference in its entirety.

Each of the wedge connectors 22, 24 includes a C-shaped member or sleeve 30 and a wedge member 40. As discussed below, a drive tool may be used to force or impel the wedge member 40 and the sleeve 30 into engagement about the conductors 12, 14 and the coupling rods 124, 134 to mechanically and electrically couple the conductors 12, 14 with the end members 120, 130.

Figure 6:
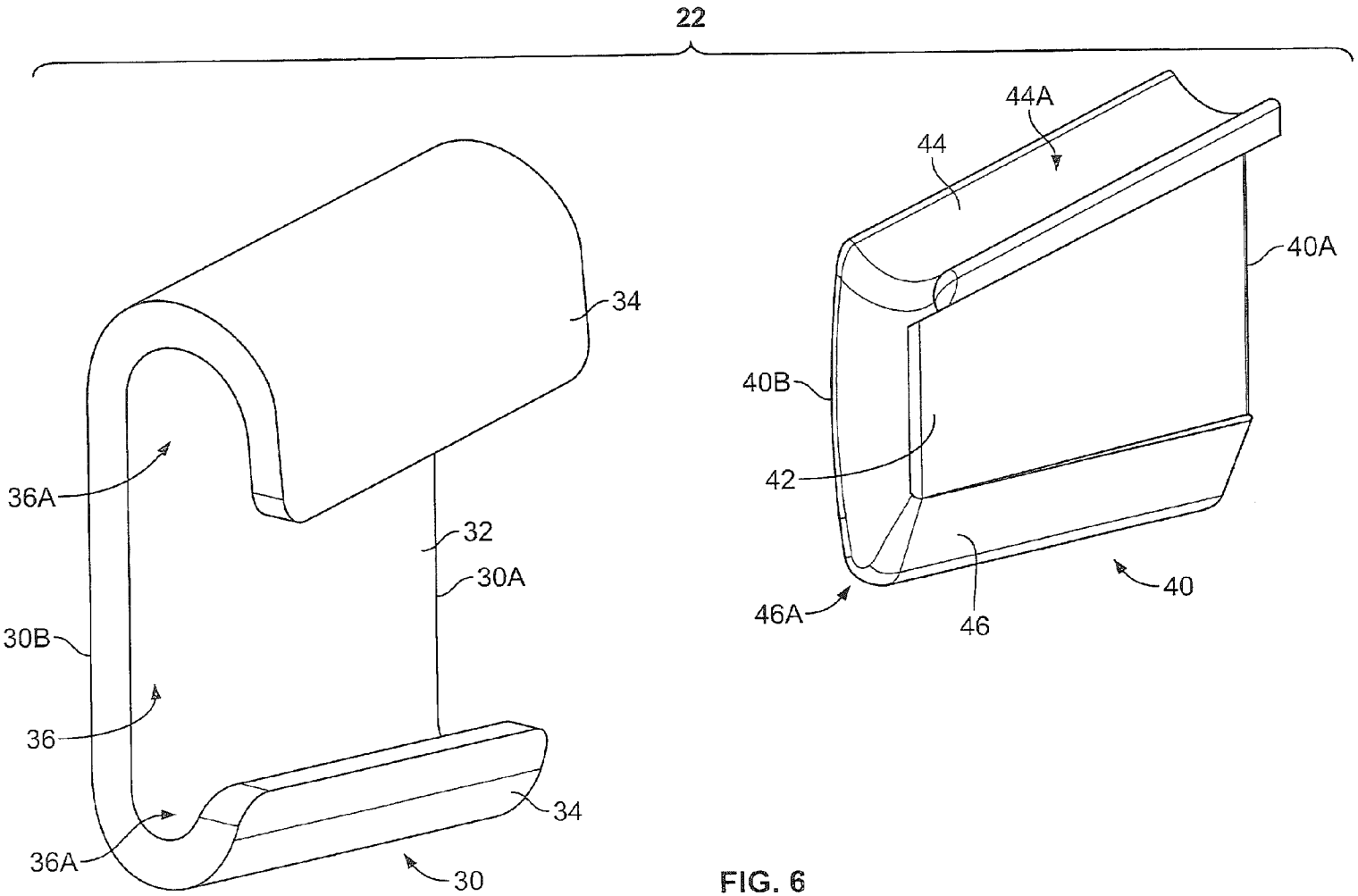
FIG. 6 is an enlarged, exploded view of a wedge connector for use with the termination assembly of FIG. 3.

With reference to FIG. 6, the C-shaped sleeve 30 includes a body 32 and a pair of arcuate side walls 34 extending along the opposed side edges of the body 32. The sleeve 30 defines a cavity 36 including opposed, concave side channels 36A. The sleeve 30 tapers inwardly from a rear end 30A to a front end 30B. More particularly, the side channels 36A taper inwardly or converge from the rear end 30A to the front end 30B.

The C-shaped sleeve 30 may be formed of any suitable material. According to some embodiments, the sleeve 30 is formed of metal. According to some embodiments, the sleeve 30 is formed of aluminum or copper alloy. The sleeve 30 may be formed using any suitable technique. According to some embodiments, the sleeve 30 is stamped (e.g., die-cut), formed, machined and/or cast.

With reference to FIG. 6, the wedge member 40 includes a body 42 having opposed, arcuate side walls 44, 46. The side wall 44 defines a concave groove or channel 44A. The side wall 46 defines a convex rib or ridge 46A. The wedge member 40 tapers inwardly from a rear end 40A to a front end 40B. The wedge member 40 may be formed of any suitable material. According to some embodiments, the wedge member 40 is formed of metal. According to some embodiments, the wedge member 40 is formed of aluminum or copper alloy. The wedge member 40 may be formed using any suitable technique. According to some embodiments, the wedge member 40 is cast and/or machined.

The C-shaped sleeve 30 and the wedge member 40 may be a C-shaped sleeve and/or a wedge member as sold by Tyco Electronics Corporation of Pennsylvania under the trademark AMPACT™, EXCLTAP™, or MINIWEDGE™. According to some embodiments, the wedge connectors 22, 24 may be constructed and installed as disclosed in U.S. Pat. No. 5,942,723 to Laricchia and/or U.S. Published Patent No. 2007/0240301 (Johnston et al.), for example, the disclosures of which are incorporated herein by reference.

With reference to FIGS. 7-11, according to embodiments of the present invention, the cable termination system 10 may be used as follows to form the in-line isolation assembly 5. The power line 16 may be an aerial power transmission line, for example. The installation may be executed in whole or in part using hot sticks and/or electrically insulating gloves with the installer working from the ground or a raised platform.

The retainer mechanisms 160 are placed in their open positions as shown in FIGS. 1 and 7 with the keeper bars 170 positioned out of the way of the conductor grooves 126, 136.

With the keeper bars 170 in the open position, the isolating apparatus 100 is laid on the power line 16 with the grooves 126, 136 facing downwardly and such that conductor segments 12, 14 of the power line 16 extend through the conductor grooves 126, 136, respectively, and between the end members 120, 130. The conductor segments 12, 14 are thereby received laterally into the grooves 126, 136 (i.e., in the direction I of FIG. 7).

The keeper bars 170 are then moved (e.g., by hand or using hotsticks) to their closed positions as shown in FIGS. 8 and 9 so that they capture the conductor segments 12, 14 in the grooves 126, 136. According to some embodiments, each keeper bar 170 must be pulled up (direction U of FIG. 7) against the load of the spring 183 in order to permit the keeper bar 170 to clear the post 166 and pivot into engagement with the latch bolt 184. The keeper bars 170 can be released after the slot 174A is positioned about the latch bolt 184. The pressure head 176 may then seat on the conductor in the corresponding conductor groove 124, 134 to prevent the keeper bar 170 from pivoting back into the open position.

With the keeper bars 170 in the closed position, the conductor segments 12, 14 cannot be removed laterally (i.e., in a direction E (FIG. 8)) with respect to the longitudinal axis C-C) from the conductor grooves 126, 136. However, because the keeper bars 160 are not yet loaded onto the conductor segments 12, 14 or are only loaded by the relatively weak pivot bolt spring 183, the conductor segments 12, 14 can still be easily rotated and axially displaced with respect to the conductor grooves 126, 136. The isolating apparatus 100 is then rotated 180 degrees about the power line 16 to the upright position as shown in FIG. 9.

The wedge clamps 22, 24 are then installed about the conductor segments 12, 14 and each coupling rod 124, 134 as shown in FIG. 9. The wedge clamps 22, 24 may be installed using a powder-actuated impact tool, for example. Suitable powder actuated impact tools include the AMPACT™ tool sold by Tyco Electronics Corporation of Pennsylvania. According to some embodiments, the powder actuated impact tool may be constructed and operated as disclosed in U.S. Pat. No. 6,851,262 to Gregory et al., the disclosure of which is incorporated herein by reference.

With the conductor segments 12 and 14 secured to the coupling rods 124 and 134, respectively, by the wedge connectors 22, 24, the retainer mechanisms 160 are each placed in their clamping position as shown in FIG. 10 by tightening down each of the pivot bolts 180 and the latch bolts 184. This may be accomplished by rotatively driving the bolt heads 180B, 184B and/or the nuts 182, 186 using a suitable driver tool, for example. The opposed end portions of each keeper bar 170 are thereby pulled inwardly, drawing the pressure head 176 thereof (cantilevered from each side) toward the corresponding conductor segment 12, 14.

In this manner, each conductor segment 12, 14 is forcibly clamped between the adjacent coupling rod 124, 134 and the corresponding pressure head 176. The compressively loaded keeper bars 170 can thereby resist, prevent or inhibit axial movement of the associated conductor segments 12, 14 in the cable grooves 126, 136. It will be appreciated that the clamping force of the loaded keeper bars 170 alone may not be sufficient to prevent axial movement of the conductors, but rather the loaded keeper bars 170 may enhance the pull out resistance provided by the wedge connectors 22, 24. According to some embodiments, each bolt 180, 184 is driven to a torque in a prescribed range to provide a clamp force or load on the conductor segment 12, 14 in a prescribed range.

The power line 16 can then be cut between the end members 120, 130 to divide the power line 16 into two separate conductor segments or conductors 12, 14. The conductors 12 and 14 are securely coupled to the end member 120 and the end member 130, respectively, by both the wedge connectors 22, 24 and the retainer mechanisms 160 so that the tension from the power line 16 is now applied to the isolating apparatus 100. The cut conductor ends 12A, 14A can then be bent away from one another as shown in FIG. 10 to electrically isolate the conductors 12, 14 from one another and/or a section of the power line 16 between the end members 120, 130 can be cut out and removed.

When it is desired to electrically connect the conductors 12, 14, the blade member 142 can be pivoted into the closed position to electrically connect the end members 120, 130. The blade member 142 can be securely and releasably retained in the closed position by the latch mechanism 146.

When it is desired to electrically isolate or disconnect the cables 12, 14, the blade member 142 can be pivoted into its open position. The lockout mechanism 148 can be used to securely and releasably retain the blade member 142 in its open position.

The in-line isolation assembly 5 and, more particularly, the termination assemblies 121, 131 in cooperation with the wedge connectors 22, 24 can provide significant advantages in installation and service. The retainer mechanisms 160 serve as load bearing mechanical clamps in the final assembly and provide an additional clamping force on the conductor segments 12, 14 in the conductor grooves 126, 136. As a result, the pullout force required to axially withdraw the conductor segment from the coupling rod 124, 134 is increased. The retainer mechanisms 160 can thus provide more secure, robust and reliable connections between the conductor segments 12, 14 and the end members 120, 130.

According to further embodiments of the present invention, the isolating apparatus 100 can be provided without the blade mechanism 140 and/or the lockout mechanism 148.

While the insulating apparatus 100 has been described herein installed on segments 12, 14 of a power line 10, according to some embodiments, the insulating apparatus 100 may be installed on each of a cable and a dead end post, for example.

While the cable termination system 10 has been described above in terms of an in-line isolation apparatus 100, according to other embodiments, the connector unit may be a dead end or other termination assembly adapted to be secured directly or indirectly to a wall or post, for example. In this case, the connector unit may include only the termination assembly 121 (with the end member 120 suitably configured to couple to the desired bracket or the like) and may be used with the wedge connector 22 only.

According to further embodiments, an in-line isolation apparatus as disclosed herein may be used without one or both of the wedge connectors 22, 24 or with supplemental connectors of other types.

The foregoing is illustrative of the present invention and is not to be construed as limiting thereof. Although a few exemplary embodiments of this invention have been described, those skilled in the art will readily appreciate that many modifications are possible in the exemplary embodiments without materially departing from the novel teachings and advantages of this invention. Accordingly, all such modifications are intended to be included within the scope of this invention. Therefore, it is to be understood that the foregoing is illustrative of the present invention and is not to be construed as limited to the specific embodiments disclosed, and that modifications to the disclosed embodiments, as well as other embodiments, are intended to be included within the scope of the invention.

That which is claimed is:

1. A conductor termination system for use with an electrical power transmission conductor, the conductor termination system comprising:

a) a termination assembly including:

an end member including a receiver portion configured to receive a segment of the conductor; and an integral retainer mechanism including a moveable keeper member on the end member, wherein the retainer mechanism is operable to selectively clamp a segment of the conductor in the receiver portion to the end member and to apply a retention load to the conductor segment; and b) a connector adapted to be applied to the end member and the conductor to securely clamp the conductor segment to the end member;

wherein:

the receiver portion has a longitudinal axis and is configured to laterally receive the conductor segment to extend along the longitudinal axis;

the retainer mechanism is selectively alternatively positionable in each of:

an open position, wherein the keeper member is positioned such that the receiver portion is open to laterally receive the conductor segment;

a clamping position wherein the keeper member is positioned to prevent removal of the conductor segment laterally from the receiver portion and to apply a clamping load to the conductor segment to resist axial displacement of the conductor segment with respect to the receiver portion; and a closed position, wherein the keeper member is positioned to retain the conductor segment and to prevent removal of the conductor segment laterally from the receiver portion while permitting axial displacement of the conductor segment with respect to the receiver portion.

2. The conductor termination system of claim 1 wherein the keeper member is pivotable about a pivot axis and across the receiver portion between the open and clamping positions.

3. The conductor termination system of claim 2 wherein:

the retainer mechanism includes a latch member on a side of the receiver portion opposite the pivot axis; and the keeper member is anchored by the latch member when in the clamping position.

4. The conductor termination system of claim 1 wherein:

the integral retainer mechanism includes at least one threaded fastener; and the keeper member can be clamped onto the conductor segment using the at least one threaded fastener.

5. The conductor termination system of claim 4 wherein the keeper member can be clamped onto the conductor segment by tightening the at least one threaded fastener.

6. The conductor termination system of claim 4 wherein:

the at least one threaded fastener includes first and second spaced apart threaded fasteners; and the keeper member can be clamped onto the conductor segment using the first and second threaded fasteners.

7. The conductor termination system of claim 1 wherein the keeper member includes an engagement portion configured to substantially conform to and transfer the clamping load to the conductor segment.

8. The conductor termination system of claim 1 wherein the connector comprises a wedge connector adapted to be force-applied to the end member and the conductor, the wedge connector including:

a sleeve member defining a sleeve cavity; and a wedge member configured to be forcibly inserted into the sleeve cavity to capture the conductor segment and the end member therebetween such that the wedge connector inhibits axial movement of the wedge connector, the conductor segment and the end member.

9. The conductor termination system of claim 1 wherein the conductor termination system is an isolating apparatus further including:

a) an elongate insulator having opposed first and second insulator ends;

b) a second termination assembly including:

a second end member including a second receiver portion configured to receive a second segment of the conductor; and a second integral retainer mechanism including a second moveable keeper member on the second end member, wherein the second keeper member is operable to selectively clamp the second conductor segment in the receiver portion to the end member and to apply a retention load to the conductor; and c) a second connector adapted to be applied to the second end member and the second conductor segment to securely clamp the second conductor segment to the second end member;

wherein the first insulator end is secured to the first end member and the second insulator end is secured to the second end member.

10. The conductor termination system of claim 9 further including a switch mechanism to selectively alternatively electrically connect and disconnect the first and second end members and thereby the first and second conductor segments.

11. The conductor termination system of claim 1 including an electrical transmission conductor, wherein:

a segment of the conductor is disposed in the receiver portion of the end member;

the conductor segment is clamped in the receiver portion by the keeper member such that relative axial displacement between the end member and the conductor segment is thereby resisted; and the conductor segment is securely clamped to the end member by the connector.

12. A method for forming a conductor termination assembly with an electrical power transmission conductor, the method comprising:

providing a termination assembly including:

an end member including a receiver portion configured to receive a segment of the conductor; and an integral retainer mechanism including a moveable keeper member on the end member;

placing a segment of the conductor in the receiver portion;

applying a connector to the end member and the conductor segment to securely clamp the conductor segment to the end member; and using the retainer mechanism, clamping the conductor segment in the receiver portion and applying a retention load to the conductor segment with the keeper member;

wherein the receiver portion has a longitudinal axis and is configured to laterally receive the conductor segment to extend along the longitudinal axis, and the method includes:

positioning the retainer mechanism in an open position, wherein the keeper member is positioned such that the receiver portion is open to laterally receive the conductor segment; thereafter placing the conductor segment in the receiver portion with the retainer mechanism in the open position; thereafter positioning the retainer mechanism in a clamping position wherein the keeper member prevents removal of the conductor segment laterally from the receiver portion and applies a clamping load to the conductor segment to resist axial displacement of the conductor segment with respect to the receiver portion; and after placing the conductor segment in the receiver portion and prior to positioning the retainer mechanism in the clamping position, positioning the retainer mechanism in a closed position, wherein the keeper member is positioned to retain the conductor segment and to prevent removal of the conductor segment laterally from the receiver portion while permitting axial displacement of the conductor segment with respect to the receiver portion.

13. The method of claim 12 wherein:

the connector comprises a wedge connector including:

a sleeve member defining a sleeve cavity; and a wedge member;

the step of applying the connector to the end member and the conductor segment is executed while the retainer mechanism is in the closed position; and applying the wedge connector to the end member and the conductor segment includes forcibly inserting the wedge connector into the sleeve cavity using a powder actuated tool to capture the conductor segment and the end member therebetween such that the wedge connector inhibits axial movement of the wedge connector, the conductor segment and the end member.

14. The method of claim 12 including pivoting the keeper member about a pivot axis and across the receiver portion between the open and clamping positions.

15. The method of claim 14 wherein:

the retainer mechanism includes a latch member on a side of the receiver portion opposite the pivot axis; and the keeper member is anchored by the latch member when in the clamping position.

16. The method of claim 12 wherein:

the integral retainer mechanism includes at least one threaded fastener; and the method includes clamping the keeper member onto the conductor segment by tightening the at least one threaded fastener.

17. The method of claim 16 wherein:

the at least one threaded fastener includes first and second spaced apart threaded fasteners; and the method includes clamping the keeper member onto the conductor segment by tightening the first and second threaded fasteners.

18. An isolating apparatus for an electrical power transmission conductor, the isolating apparatus comprising:

a) an elongate insulator having opposed first and second insulator ends; and b) a first termination assembly including a first end member and a second termination assembly including a second end member, wherein the first insulator end is secured to the first end member and the second insulator end is secured to the second end member, and wherein the first termination assembly further includes:

a receiver portion of the first end member configured to receive a segment of the conductor; and an integral retainer mechanism including a moveable keeper member on the first end member, wherein the retainer mechanism is operable to selectively position the keeper member to prevent removal of a segment of the conductor laterally from the receiver portion and to apply a clamping load to the conductor segment to resist axial displacement of the conductor segment with respect to the receiver portion;

wherein:

the receiver portion has a longitudinal axis and is configured to laterally receive the conductor segment to extend along the longitudinal axis; and the retainer mechanism is selectively alternatively positionable in each of:

an open position, wherein the keeper member is positioned such that the receiver portion is open to laterally receive the conductor segment;

a clamping position wherein the keeper member is positioned to prevent removal of the conductor segment laterally from the receiver portion and to apply a clamping load to the conductor segment to resist axial displacement of the conductor segment with respect to the receiver portion; and a closed position, wherein the keeper member is positioned to retain the conductor segment and to prevent removal of the conductor segment laterally from the receiver portion while permitting axial displacement of the conductor segment with respect to the receiver portion.

19. The isolating apparatus of claim 18 further including a switch mechanism to selectively alternatively electrically connect and disconnect the first and second end members.

20. The isolating apparatus of claim 18 wherein:

the integral retainer mechanism includes at least one threaded fastener; and the keeper member can be clamped onto the conductor segment using the at least one threaded fastener.

21. The isolating apparatus of claim 20 wherein:

the at least one threaded fastener includes first and second spaced apart threaded fasteners; and the keeper member can be clamped onto the conductor segment using the first and second threaded fasteners.

22. The isolating apparatus of claim 20 wherein the keeper member can be clamped onto the conductor segment by tightening the at least one threaded fastener.

* * * * *